United States Patent [19]

Koehler et al.

[11] Patent Number: 4,674,254

[45] Date of Patent: Jun. 23, 1987

[54] WOOD TRACK SUSPENSION CEILING SYSTEM

[76] Inventors: David J. Koehler, R.R. 1 Box 63; Mark G. Koehler, 602 S. Hampton St., both of Fairmont, Minn. 56031

[21] Appl. No.: 666,232

[22] Filed: Oct. 29, 1984

[51] Int. Cl.[4] ..... E04B 5/52

[52] U.S. Cl. ..... 52/484; 52/486

[58] Field of Search ..... 52/484, 486, 488, 665

[56] References Cited

U.S. PATENT DOCUMENTS

| | | | |
|---|---|---|---|
| 2,981,386 | 4/1961 | Reske et al. | 52/484 X |
| 4,281,498 | 8/1981 | Kern | 52/665 X |
| 4,367,616 | 1/1983 | Pearson | 52/484 X |
| 4,454,700 | 6/1984 | Kern | 52/665 |
| 4,464,876 | 8/1984 | Kern | 52/484 |
| 4,545,165 | 10/1985 | Carey et al. | 52/484 |

*Primary Examiner*—Carl D. Friedman

*Attorney, Agent, or Firm*—Don E. Ferrell

[57] ABSTRACT

A wooden suspended ceiling assembly is designed to support acoustical tiles and is constructed of a plurality of interlocking wooden members. Cross-extending wooden beams are joined together by notched connectors with the notched connectors being attachable to a conventional ceiling by hooks. The cross-extending wooden members are provided with upwardly extending dowels for positioning tiles, while sidewall and corner connectors also comprise notched wooden blocks.

1 Claim, 2 Drawing Figures

WOOD TRACK SUSPENSION CEILING SYSTEM

BACKGROUND OF THE INVENTION

1. Field of the Invention

The present invention relates to suspended ceiling assemblies for retaining conventional ceiling tiles and more particularly pertains to a new and improved suspended ceiling assembly which is constructed entirely of wood so as to provide an aesthetically attractive ceiling structure.

2. Description of the Prior Art

Suspended ceiling assemblies for retaining conventional ceiling panels are well known in the art. Various models and designs are available, and virtually all of the commercially available assemblies function well for their intended purpose. The majority of the conventionally available suspended ceiling assemblies are formed from metallic members and are not particularly aesthetically attractive. To offset the unattractive appearance of the suspended ceiling assemblies, various manufacturers have introduced attractive and uniquely designed ceiling tiles for use with the ceiling suspension systems. However, the use of attractive ceiling tiles alone will not completely offset the unattractive appearance of the more conventional suspended ceiling support assemblies.

At least one attempt has been made to provide an aesthetically pleasing and attractive suspended ceiling assembly. In this respect, reference is made to U.S. Pat. No. 4,367,616, which issued to R. Pearson on Jan. 11, 1983, and which is directed to a wooden beam suspended ceiling assembly. In effect, the Pearson patent discloses a suspended ceiling assembly which includes a support structure made substantially out of wood for the purpose of providing the unique aesthetic appeal of a wood beam ceiling. However, the wooden beam suspended ceiling assembly of Pearson is specially designed and cut to form a complex interlocking arrangement, and the complexity of maufacture and assembly of this particular ceiling assembly makes the same somewhat economically unfeasible, as well as being substantially difficult to assemble.

Accordingly, it can be appreciated that there exists a substantial need for a new and improved aesthetically pleasing wooden beam suspended ceiling assembly which can be economically and quickly manufactured and which can be assembled in an easy and rapid manner, and in this respect, the present invention susbstantially fulfills this need.

SUMMARY OF THE INVENTION

The general purpose of the present invention, which will be described subsequently in greater detail, is to provide a new and improved wood track suspension ceiling system that has all of the advantages of the prior art ceiling suspension systems and none of the disadvantages. In this regard, the present invention is directed to a suspended ceiling assembly for supporting a plurality of ceiling panels over a defined area, with the support structure for the ceiling panels being manufactured completely from wood. The structure of the assembly includes cross members or struts which are positionable between block-shaped connectors that may be suspended from the ceiling by hooks. The cross members are provided with upwardly extending dowels which serve to retain the ceiling panels in position, while corner and sidewall connectors also comprise notched blocks for receiving the cross members.

It is therefore an object of the present invention to provide a new and improved wood track suspension ceiling system that has all of the advantages of the prior art suspension ceiling systems and none of the disadvantages.

It is another object of the present invention to provide a new and improved wood track suspension ceiling system which may be easily and efficiently manufactured and which may be assembled and used in a rapid and easily understood manner.

It is a further object of the present invention to provide a new and improved wood track suspension ceiling system which will prove to be of a durable and rugged construction during an extended use period.

Even another object of the present invention is to provide a new and improved wood track suspension ceiling system that is susceptible of a low cost of manufacture with regard to both materials and labor, and which accordingly is then susceptible of low prices of sale to the consuming public, thereby making such construction economically available to the buying public.

Still yet another object of the present invention is to provide a new and improved wood track suspension ceiling system which provides in the apparatuses and methods of the prior art some of the advantages thereof, while simultaneously overcoming some of the disadvantages normally associated therewith.

An even further object of the present invention is to provide a new and improved wood track suspension ceiling system which is constructed entirely of wood so as to be aesthetically attractive.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENT

Figure 2:
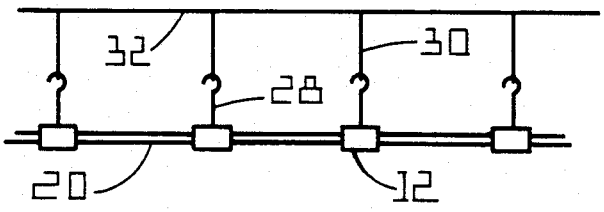
FIG. 2 is a partial side view of the system showing ceiling tiles being retained in place.
Figure 2:
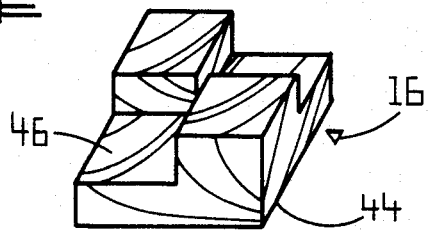
Figure 1:
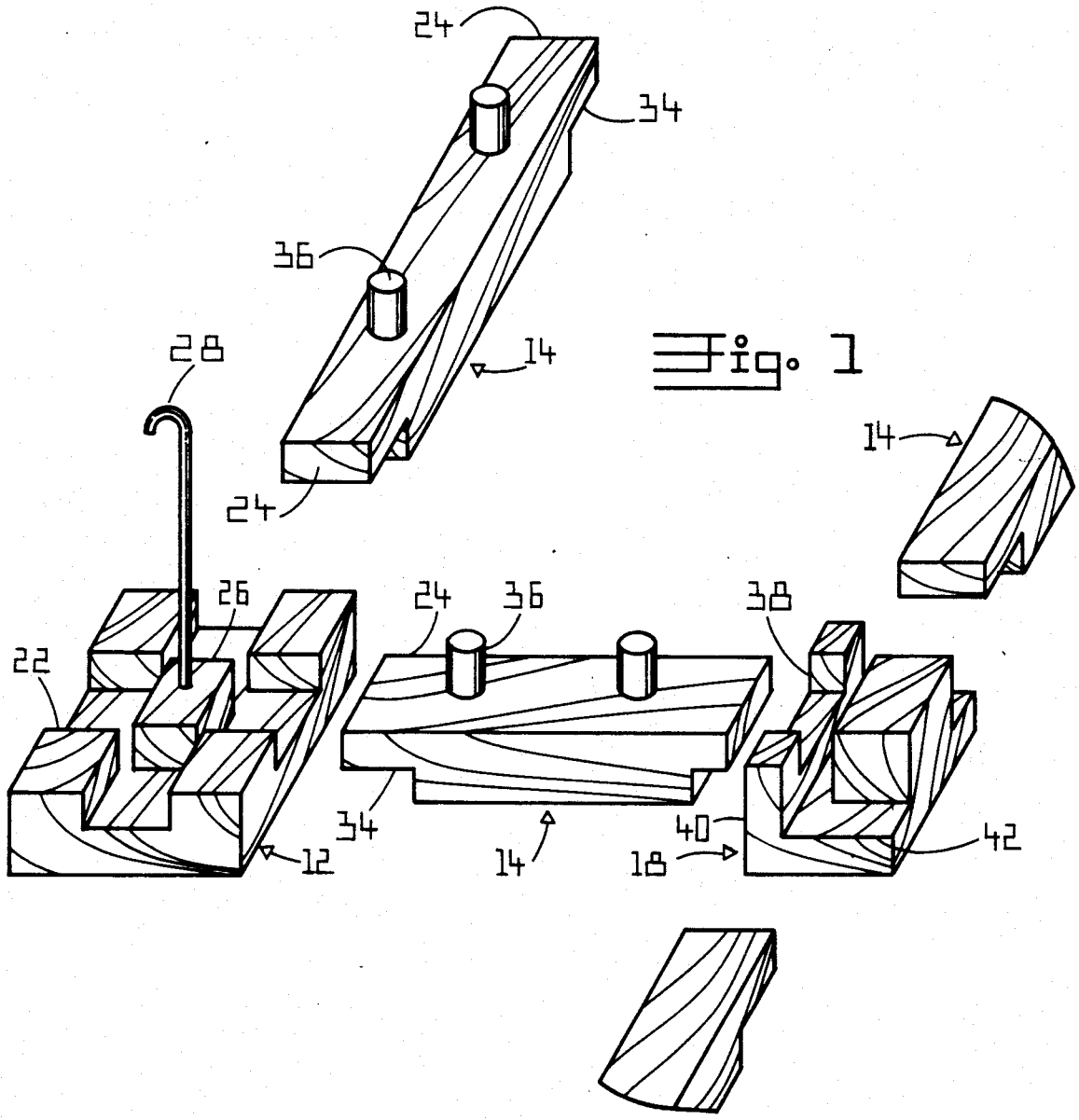
FIG. 1 is an exploded perspective view of the various wooden components comprising the wood track suspension ceiling system of the present invention.

With reference now to the drawings and in particular to FIG. 1 thereof, a new and improved wood track suspension ceiling system embodying the principles and concepts of the present invention and generally designated by the reference numeral 10 will be described. As shown, the basic components of the system include block-shaped connectors 12, cross-extending members or struts 14, corner connectors 16 and sidewall connectors 18. These components 12, 14, 16, 18 are separably interconnectible in the manner illustrated to form retaining arrangements for conventional ceiling tiles 20 as illustrated in FIG. 2.

With respect to the construction of a center connector 12, it can be seen that the same comprises a block of wood having a plurality of notches 22 along a top portion thereof. The notches 22 are centrally positioned on each of the four sides and top portions of the block 12 and are designed to receive an extended portion 24 of a strut 14. A center portion 26 of the block 12 is unnotched and is designed to receive an upwardly extending metallic hook 28, or some other type of fastening member, which may conveniently receive conventional ceiling wire 30 as best illustrated in FIG. 2. The ceiling wire 30 is, of course, interconnected in a fixed manner between a ceiling 32 and a hook 28 so as to retain a particular block connector 12 in position. The hook 28 may be attached to a block by any conventional and known means, such as by threaded interconnection, glue, or the like. As can be appreciated, the block connectors 12 are designed to be mounted from a ceiling 32 away from the associated sidewalls and corners thereof.

With respect to the construction of the aforementioned struts 14, it will be noted that the struts are essentially elongated rectangular wooden members having the aforementioned extending connecting ends 24 which are formed by cutting notches 34 along bottom end portions thereof. The struts 14 will have the extended end portions 24 at both of its free ends, while a pair of dowels 36 may be fixedly secured along a top surface of a strut with such dowels extending vertically upwardly therefrom. The dowels 36 serve to abut against the edges of a conventional ceiling panel 20 to retain the same in position once the ceiling panel has been installed thereon.

FIG. 1 shows the sidewall connector 18 construction as being substantially a L-shaped wooden member having a notch 38 centrally positioned along an upwardly extending sidewall 40. The notch 38 is designed to receive an extended end 24 of a strut 14 in a manner clearly illustrated in FIG. 1, while the sidewall connector may be conveniently attached to a sidewall by any conventional means, to include screws, nails, glue, and the like. The sidewall connector 18 further includes a second notch 42 formed by a horizontal leg thereof with the second notch being designed to receive a further strut 14 or some other design of wooden sidewall member.

Corner connector 16 is specifically designed for use in corners and includes an outwardly extending leg portion 44 which is designed to provide a planar support surface 46 about two faces of the connector. The surface 46 is designed to receive the extended ends 24 of struts 14 in a now apparent manner, while the surface may be formed either by cutting or the fixed securing of two separate blocks of wood together.

With respect to the manner of usage of the present invention, the corner connector 16 and the sidewall connectors 18 would first be securely positioned about the periphery of a room at a height which defines the desired location of a drop ceiling. At the appropriate distances therefrom and interiorly of the sidewalls, a plurality of block connectors 12 may then be secured to a ceiling through the use of attachment wires 30 and once these are correctly positioned, the struts 14 may be dropped into position whereby their extended ends 24 engage the notches 22, 38 and surfaces 46. Once the entire support assembly is in position, conventional ceiling panels 20 may then be dropped in position through the open areas therebetween, and the upwardly extending dowels 36 serve to secure the panels in a substantially fixed engagement with the ceiling assembly 10 forming the present invention.

The average dimensions of a block connector 12 would be three inches square by one and one-half inches in height. The central area the top of each side would include the aforementioned notches 22 which would typically be one and half inches wide and three-eights inches deep. This in effect then forms a three-quarter inch square central block 26, as aforedescribed, within the center of the connector 12.

The struts 14 would have typical dimensions of three-quarter inches in thickness and one and a half inches in width, with the length of the struts then being variable, either twenty-two and a quarter inches or forty-six and one-quarter inches, as would relate to accommodating two foot square or two by four foot sections of ceiling tile. The extended ends 24 of the struts would typically be three-eighths of an inch high.

A typical corner connector 16 could be formed by cutting standard connectors into sections wherein a one-fourth section would be used for an inside corner and a three-quarter section would be used for an outside corner. A one-half section of the connector could be used at the juncture of a wall and ceiling area, thereby to form a sidewall connector 18.

The components of the wood track suspended ceiling system could be produced in various colors, such as natural stains, or could be provided unfinished for final finishing by an installer. Producing as unfinished items would then permit a precise coloration and surface treatment to be chosen by the user. Surfaces of the wood materials could also be provided with a variety of textures, grooves, or other decorative designs such as those similar to the production of more conventional picture frame materials. Even elaborate decorative designs could then be produced, such as those which would incorporate filligre or gold leaf.

While wood materials are viewed as a basic approach to production, the potential also exists for the use of other materials to form the components. Notably, the use of molded plastics is within the intent and purview of the present invention since they may be easily produced in standard colors, as well as to incorporate various decorative textures.

Elements of the wood track suspended ceiling system of the present invention would logically be sold in kit form, as well as individually as accessory items. This then permits a user to purchase a basic quantity of elements, such as might be used in an average size room, and additional elements, such as outside corners and additional struts and trim sections, could then be purchased separately in the quantity required.

With respect to the above-description then, it should be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new and desired to be secured by Letters Patent of the United States is as follows:

1. A new and improved suspension ceiling system for retaining conventional ceiling panels, said suspension ceiling system comprising:

(a) corner connection means;

(b) sidewall connection means;

(c) center connection means; and (d) cross-extending member means, said cross-extending member means being engageable with at least one of said corner connection means, said sidewall connection means, and said center connection means to form said suspension ceiling system for retaining conventional ceiling panels, wherein said center connection is provided with an upward extending hook member for facilitating an attachment of said center connection means to a ceiling, wherein said center connection means further includes a pluarlity of notches on a topmost surface thereof, said notches serving to receive ends of said cross-extending member means and wherein said cross-extending member means are provided with bottommost notches on respective ends thereof so as to form extended portions engageable with said notches on said center connection means, and further wherein said corner connection means is of a substantially rectangular shape and includes a bottommost L-shaped extending portion which forms a horizontal planar surface on at least two faces thereof, said horizontal planar surface serving to receive end portions of said cross-extending member means.

* * * * *